United States Patent [19]

Grauel

[11] 3,951,363

[45] Apr. 20, 1976

[54] KEELED KITE CONSTRUCTION

[76] Inventor: Edwin L. Grauel, 799 Elmwood Terrace, Rochester, N.Y. 14620

[22] Filed: Nov. 27, 1974

[21] Appl. No.: 527,742

[52] U.S. Cl. ..... 244/153 R
[51] Int. Cl.[2] ..... B64C 31/06
[58] Field of Search ..... 244/153 R, 145, 146; D34/15 AF

[56] References Cited

UNITED STATES PATENTS

| | | | |
|---|---|---|---|
| 1,005,810 | 10/1911 | Conyne | 244/153 R |
| 2,472,137 | 6/1949 | Winslow | 244/153 R |
| 3,347,500 | 10/1967 | Hartig | 244/153 R X |

*Primary Examiner*—Trygve M. Blix
*Assistant Examiner*—Barry L. Kelmachter
*Attorney, Agent, or Firm*—Scrivener Parker Scrivener and Clarke

[57] ABSTRACT

A construction for a keeled kite wherein the keel is a flexible tubular member fixed to the underside of a kite canopy and is open at its leading end and closed at its trailing end so as to be inflated by the oncoming wind to stabilize the kite under varying wind conditions which would cause kites having conventional flat keels to power loop or crash, either because of excessive wind velocity or because of low wind velocity.

8 Claims, 5 Drawing Figures

KEELED KITE CONSTRUCTION

This invention relates to kites and more particularly to keeled kites.

Keeled kites are well-known, a popular type being the so-called delta-winged knife having a horizontal canopy to which there is vertically attached a single flat keel with both the keel and wing being composed usually of flexible plastic sheet material. There are also multi-keeled kites, one being shown and described in applicant's prior Pat., No. 3,740,008. The object of the present invention is to provide a keel construction which is a marked improvement over the flat vertical keels used heretofore either with delta wing kites or kites having multiple keels.

More particularly it is an object of the invention to provide a keel construction for keeled kites which not only performs its stabilizing function, in that it resists tendency of a kite to side slip, but it stabilizes the kite under a wide range of wind conditions, either high or low velocity, which might cause kites having flat keels to power loop or crash.

A more specific object of the invention is to provide a kite keel construction which, while approximating the configuration of a conventional flat keel, is nevertheless in tubular form, closed at its trailing end and open at its leading end so as to be inflated by the oncoming wind and thereby enabled to maintain its effectiveness over a wide range of wind conditions, varying from very light to heavy velocity, while at the same time imparting to the kite substantially improved flying qualities.

Other objects and their attendant advantages will become apparent as the following detailed description is read in conjunction with the accompanying drawings wherein.

Figure 4:
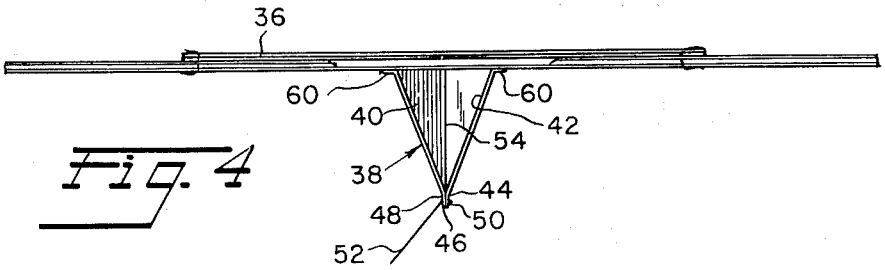
FIG. 4 is a front elevational view of the kite.
Figure 3:
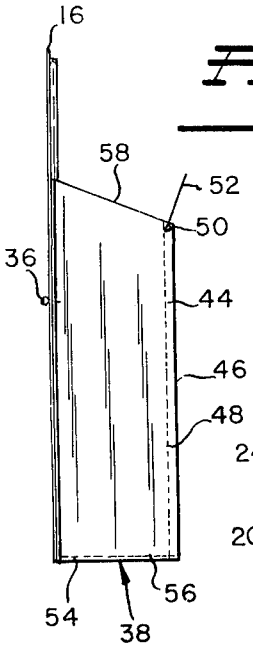
FIG. 3 is a side elevational view of the kite.
Figure 2:
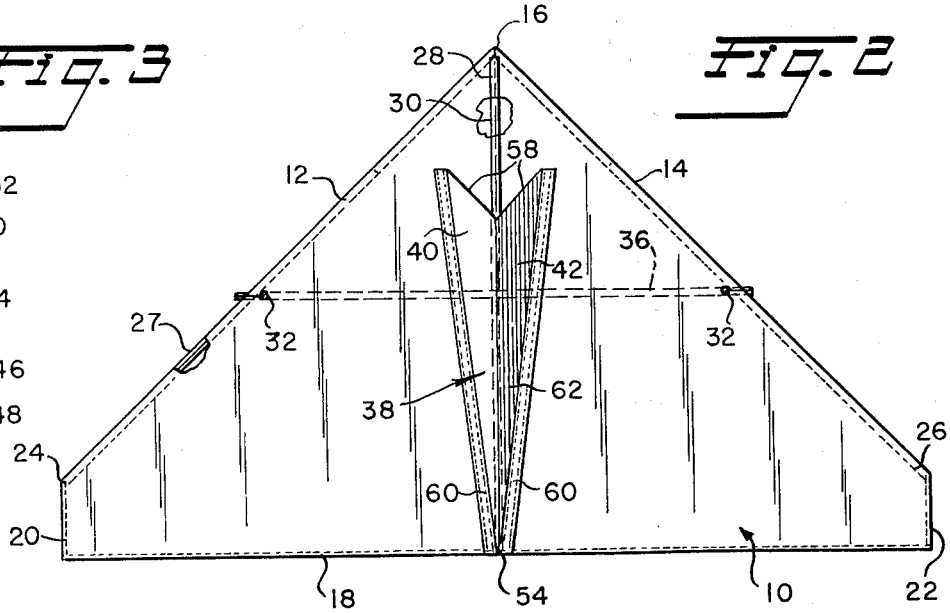
FIG. 2 is a bottom plan view of the kite of FIG. 1.
Figure 5:
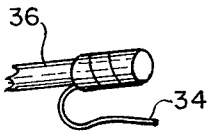
FIG. 5 is an enlarged broken, detailed view of the end connection of a releasable stiffening strut used with the kite of FIG. 1.
Figure 1:
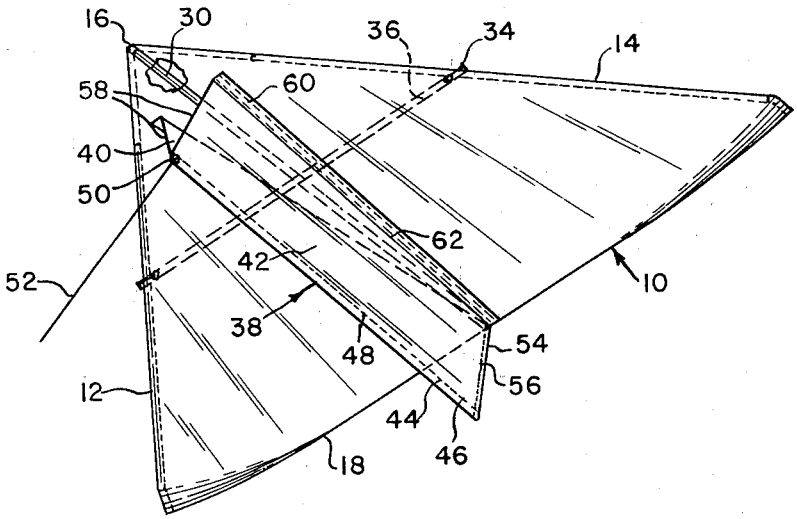
FIG. 1 is a perspective view, with portions broken away, of the underside of a delta wing kite employing the improved keel of the present invention.

Referring now to the drawings, for purposes of illustration a kite embracing the invention is shown and described as being a delta wing kite of fabric material, though it could as readily be of other configuration and of other suitable limp or flexible sheet material such as plastic or the like. The kite shown comprises an essentially triangular canopy 10 having a pair of converging side edges 12,14, which intersect to define a nose 16, a rear edge 18 and a pair of short edge portions 20,22 at right angles to the rear edge 18 and intersecting at 24, 26 the side edges 12, 14 of the canopy. These latter edges are seamed to provide elongated pockets in which are located stiffening struts 27 which extend partly along the edges 12, 14 from the point 24, 26 to about three-quarters of the distance to the nose 16. The struts may be prevented from sliding forwardly out of position by suitable stitching at the points 24, 26 which pass through openings in the ends of the struts and through the material of the canopy.

A central seam 28 is also provided in the canopy material between the nose 16 and the center of the rear edge 18 and sewn into this seam is another strut 30 which is coextensive with the seam. A pair of reinforced eyelets 32 are formed through the canopy material at points intermediate the ends of the side struts 27 for the reception of hook-like members 34 fixed to the ends of a releasable strut 36 which may be sprung to engage the hook-like members 34 with the eyelets 32 for retention of the kite in its flying condition. The strut is readily removed to permit the kite to be collapsed for storage or transport purposes.

The described canopy of the kite is substantially conventional and it is provided with a keel constructed in accordance with the invention and designated generally by the numeral 38. As can be seen the keel may be formed of a unitary piece of flexible fabric material folded upwardly so as to define a pair of flat side walls 40, 42. A line of stitching 44 connects the two walls adjacent their fold line 46, the fabric between the stitching and the fold line defining a bottom seam 48 of double thickness, the forward end of which carries a reinforced eyelet or grommet 50 to which a kite string 52 may be attached, it being understood that the grommet is located in a position relative to the fore and aft axis of the kite which enables the kite to rise in an air current against the resistance of the string. By disposing the grommet at the forward end of the bottom seam 48, the force of the kite string aids in preventing the leading edges of the side walls from fluttering.

The trailing edges 54 of the walls 40,42 of the keel are sewed together by a line of stitching 56, and the leading edges 58 of the walls 40, 42 slope forwardly from the forward end of the bottom seam 48 and are arranged to diverge upwardly as shown, with upper edges of the walls being folded outwardly to define longitudinally extending, rearwardly converging horizontal flaps 60, which terminate at their rear ends at the upper end of the line of stitching 56, sewing the trailing ends of the side walls together. The flaps 60 are sewed to the underside of the canopy 10, preferably by a double line of stitching 62 as shown.

From the foregoing description it will be seen that the keel 38 of the kite comprises a tube, substantially triangular in cross section, open at its leading end and trailing rearwardly to a closed trailing end. Preferably the keel has a substantial, approximately uniform depth throughout its length, with the forwardly sloping leading edges 58 of the side walls defining, with the underside of the canopy, a scoop into which oncoming air blows to inflate the keel, so that it not only functions as a stabilizer, as does a conventional flat keel, but it also provides flying qualities to the kite simply not possessed by kites having conventional flat keels.

With the inflated keel of the invention, the kite is more easily launched, has marked stability and has floating type of action after it is air-borne. The inflated somewhat balloon-like keel causes the kite to tilt slightly forwardly at its leading edge when under pull from the kite string, causes the kite to fly almost parallel to the ground when the pull on the string is relaxed and causes the kite to float in an almost stationary position when pull on the string is released. Additionally the kite flies at an unusually high angle of elevation.

Most kites having a flat keel will power loop or dive to the ground when wind velocity freshens to a fairly low level. With the inflated keel of the invention the kite can fly without power looping or diving in winds up to 25 to 30 miles per hour which is far in excess of the velocity which can be tolerated by conventional kites without power looping, and usually crashing to their destruction on the ground. Furthermore should the wind velocity be diminished to less than about 3 miles per hour, the kite does not stall, plane or crash land but rather floats slowly, almost vertically to the ground. This is due to the fact that the keel continues to remain inflated to stabilize the kite even in very low velocity wind whereas a flat keel, without the opposing forces of the string and canopy operating on it to keep it stretched out, merely flaps limply in light velocity air and performs no function so that all too often the kite crashes on one wing possibly damaging it. Because of the balloon effect, the kite rises almost vertically from the hand of the user without running or requiring that a helper hold the kite at some distance from the user. Thus the kite may be readily launched from a stationary position, as for example from the stern of a boat, and may be metallized for use as a radar reflector for rescue or similar operations.

Though the inflated keel has been described in conjunction with a delta-wing kite and is particularly effective for such use, the keel is not limited to such kites but may be used as effectively with any kite employing one or more keels, as for example, multi-keeled kites having aero-foil shaped canopies or with kites of the type shown and described in my above mentioned prior patent.

Though the kite including the keel of the invention has been described as being of fabric with adjoining parts being connected together by stitching, this is for purposes of illustration only. The kite may be constructed of any other suitable flexible sheet material, such as plastic or the like with means suited to the material being used to join the parts together, for example, adhesives or thermoplasticwelding.

An additional advantage of a kite constructed in accordance with the described invention is that it may be readily flown, by novices in winds ranging from about 2 to 30 m.p.h. with no adjustments being required for the prevailing wind conditions. The kite practically flies itself no matter what the user may do wrong. In other words, it takes most of the disappointments away from the novice flier.

Though the described configuration for the keel has been tested and found to be optimum, clearly its shape could vary over a reasonably wide range without departing from the scope and spirit of the invention as delineated in the appended claims.

What is claimed is:

1. A kite comprising a substantially horizontal canopy having upper and lower faces and a substantially vertical keel secured to and depending freely from the lower face of said canopy between its leading and trailing edges for stabilizing said kite while in flight, said canopy extending laterally on opposite sides of said keel to define wing portions of said kite, said keel comprising a tubular member of limp sheet material having an open leading end and a closed trailing end, and means for attaching a kite string to the lower edge of said tubular member in a position relative to the fore and aft axis of the kite which enables said kite to rise in an air current and said tubular member to be inflated by air entering the open leading end of the tubular member as the result of relative movement in opposite directions of said kite and said air whereby said tubular member is retained in a keel configuration to continue to stabilize said kite even when the true wind velocity has fallen to an insignificantly low value.

2. The kite of claim 1 wherein said keel has relative to said canopy a substantially uniform depth from its leading to its trailing end.

3. The kite of claim 1 wherein no part of said keel is reinforced by stiffening members.

4. The kite of claim 1 wherein said kite is a delta wing kite and said keel is centrally disposed between the apex of said canopy and said trailing edge.

5. The kite of claim 1 wherein said tubular member comprises a pair of side walls connected together along their length at their lower edges and diverging at their leading edges to define the open leading end of said tubular member, said side walls being connected together at their trailing ends to define the closed trailing end of said tubular member.

6. The kite of claim 5 wherein the side walls of said keel converge rearwardly towards the closed trailing end of said tubular member.

7. The kite of claim 6 wherein said keel has relative to said canopy a substantially uniform depth from its leading to its trailing end.

8. The kite of claim 5 wherein said side walls are flat and define with the portion of the canopy between said walls a tubular member which is triangular in cross section from its leading to its trailing end.

* * * * *